US005378965A

United States Patent [19]

Dakin et al.

[11] Patent Number: 5,378,965

[45] Date of Patent: Jan. 3, 1995

[54] LUMINAIRE INCLUDING AN ELECTRODELESS DISCHARGE LAMP AS A LIGHT SOURCE

[75] Inventors: James T. Dakin, Shaker Heights, Ohio; Lawrence W. Speaker, Hendersonville, N.C.; Mark E. Duffy, Shaker Heights; Raymond A. Heindl, Euclid, both of Ohio

[73] Assignee: General Electric Company, Schenectady, N.Y.

[21] Appl. No.: 11,088

[22] Filed: Jan. 29, 1993

Related U.S. Application Data

[63] Continuation of Ser. No. 787,158, Nov. 4, 1991, abandoned.

[51] Int. Cl.[6] ..... H05B 41/16

[52] U.S. Cl. ..... 315/248; 315/344; 313/111; 313/234; 313/638

[58] Field of Search ..... 315/248, 344; 313/111, 313/113, 638, 44, 46, 234; 362/296

[56] References Cited

U.S. PATENT DOCUMENTS

| | | | |
|---|---|---|---|
| 3,248,548 | 4/1966 | Booth et al. | 250/199 |
| 3,763,392 | 10/1973 | Hollister | 315/248 |
| 3,860,854 | 1/1975 | Hollister | 315/248 |
| 3,932,780 | 1/1976 | DeCaro | 313/113 |
| 4,080,545 | 3/1978 | Gallo | 313/111 |
| 4,099,090 | 7/1978 | Corth | 313/487 |
| 4,877,991 | 10/1989 | Colterjohn, Jr. | 313/22 |
| 4,910,439 | 3/1990 | El-Hamamsy | 315/248 |
| 4,950,059 | 5/1990 | Roberts | 313/567 |
| 4,965,488 | 10/1990 | Hihi | 313/111 |
| 5,006,763 | 4/1991 | Anderson | 315/248 |
| 5,032,757 | 7/1991 | Witting | 315/248 |
| 5,140,227 | 8/1992 | Dakin et al. | 315/248 |

*Primary Examiner*—Robert J. Pascal
*Assistant Examiner*—Haissa Philogene
*Attorney, Agent, or Firm*—George E. Hawranko; Stanley C. Corwin

[57] ABSTRACT

An electrodeless discharge lamp comprising an arc tube constructed of a light-transmissive material. An exciting structure surrounds the arc tube and is energizable with radio frequency current to develop an arc discharge. A reflective coating of non-conducting insulating material is disposed on the arc tube wall and is located to reflect light from the arc discharge through the arc tube. The reflective coating and the uncoated portion of the arc tube wall are surrounded by the exciting structure so that light from the arc discharge may reach the reflective coating without blockage by the exciting structure and, following reflection by the coating, travel through the uncoated portion of the arc tube wall.

23 Claims, 4 Drawing Sheets

LUMINAIRE INCLUDING AN ELECTRODELESS DISCHARGE LAMP AS A LIGHT SOURCE

This application is a continuation of application Ser. No. 07/787,158, filed Nov. 4, 1991, now abandoned.

FIELD OF THE INVENTION

This invention relates to a luminaire that includes as its light source an electrodeless discharge lamp and, more particularly, relates to a luminaire of this type that includes as its light source an electrodeless, high-intensity discharge (HID) lamp and further includes an enclosure surrounding the lamp and having an opening through which light developed by the lamp is reflected by reflecting means located within the enclosure.

BACKGROUND

A known inductively-driven electrodeless high-intensity discharge (HID) lamp comprises an arc tube having a wall of light-transmissive material. An excitation coil surrounds the arc tube and is energizable with radio frequency current to develop a toroidal arc discharge within the arc tube. When such a lamp is relied upon as the light source for a luminaire, the lamp may be supported within an enclosure that includes a wall portion surrounding the lamp and terminating in a opening through which light from the lamp is transmitted. Aligned with this opening, there may be a refractor of light-transmissive material for receiving the light passing through the opening and typically having prismatic surfaces especially shaped to distribute this light in a desired pattern.

A large portion of the light transmitted through the refractor is reflected light and, more specifically, light developed by the toroidal arc discharge and reflected from reflecting means provided within the luminaire. In most prior luminaires the principal reflecting means is constituted by one or more surfaces of the above-described enclosure which have good light-reflective characteristics. Such surfaces of the enclosure are configured so that light rays from the lamp which strike these surfaces are reflected from the surface through the refractor at the forward end of the enclosure. In the type of luminaire that we are concerned with, i.e., one that uses an electrodeless discharge lamp as its light source, there is a significant problem if the principal reflecting means is of the above-described type, i.e., reflecting surfaces on the enclosure. More specifically, in the case of the inductively-driven, electrodeless HID lamp, the presence of the excitation coil that surrounds the arc tube constitutes an impediment to the passage of light rays from the toroidal arc to the principal reflecting surfaces and also an impediment to the passage of light rays from the principal reflecting surfaces through the refractor at the forward end of the enclosure. Such blockage can significantly reduce the efficiency of the luminaire.

While it is possible to design the principal reflecting surfaces so that light reflected therefrom will follow paths that avoid the excitation coil and other associated impediments, this approach typically requires that some of the light rays be reflected more than once off these surfaces before exiting through the forward end of the enclosure. This is disadvantageous because each reflection involves some loss of light, typically about 10%, which reduces the efficiency of the luminaire. Secondly, the multiple reflection approach is disadvantageous because its use results in light rays arriving at individual points on the refractor at widely varying incident angles, and this tends to reduce the effectiveness of the refractor in functioning as desired to direct light via predetermined paths as it emerges from the refractor. This problem is further discussed in the next paragraph.

Another disadvantage of relying upon principal reflecting surfaces on or near the enclosure is that these reflecting surfaces must be of a specular character in order to effectively cooperate with the optics of the refractor. More specifically, such cooperation is best assured if substantially all the light striking a given point on the prismatic surface of the refractor approaches this point via a precise, predetermined path. This is possible if substantially all the reflected light reaching the prismatic surface is reflected light from carefully designed specular reflecting surfaces. But if the reflecting surfaces are far from the light source and especially if they are diffuse reflecting surfaces, the light arriving at the refractor from the reflecting surfaces will approach each point on the prismatic surface of the refractor via many diverse paths. This significantly detracts from the desired ability of the prismatic surface to direct this light via a precise path as it emerges from the prism. Accordingly, diffuse reflective surfaces are avoided in the typical refractor-containing luminaire.

An example of a light source utilizing an electrodeless discharge arrangement and reflective surfaces in close proximity to the light source can be found in U.S. Pat. No. 3,248,548 issued to Booth et al on Apr. 26, 1966. It can be seen from this patent that a laser generating device provides a reflective coating over substantially the entire surface of the arc tube having only an aperture opening through which the light is output thereby affecting a laser delivery.

Therefore, it would be advantageous to provide, in a luminaire that includes as its light source an electrodeless discharge lamp, reflecting means so constructed that light rays from the arc discharge within the lamp can reach the reflecting means and be reflected therefrom through the forward end of the luminaire enclosure without significant interference from the excitation means (e.g., the excitation coil) of the lamp and without requiring multiple reflections in order to avoid the excitation means when passing from the reflecting means to the forward end.

In U.S. Pat. Nos. 3,763,392—Hollister and 3,860,854—Hollister, there is disclosed an inductively-driven, electrodeless HID lamp in which a reflecting chamber is provided about the arc tube and between the arc tube and the exciting coil. The outer wall of this reflecting chamber is of a reflective material or is coated to be reflective and thus acts as a reflector for light generated within the arc tube. A disadvantage of this construction is that the reflector is still spaced a substantial distance from the arc tube and thus is unable to cooperate as effectively as might be desired with the optics of any refractor in view of the above-described tendency of distant reflecting surfaces to cause the reflected light to approach each point on the refractor via many diverse paths.

In U.S. Pat. No. 4,910,439—El-Hamamsy et al, there is disclosed an electrodeless discharge lamp comprising an arc tube and a reflecting chamber (40) positioned in a location similar to that described above for the reflecting chamber of the Hollister patents. Within this chamber 40 of El-Hamamsy are mounted discrete reflecting elements 44 and 44' spaced from the arc tube and acting as principal reflectors for light generated within the arc tube. These reflectors, like those of Hollister, are still spaced a substantial distance from the arc tube and thus are subject to substantially the same disadvantages as pointed out above in connection with the reflectors of Hollister.

As pointed out in more detail hereinafter, the light reflected off this reflective coating on the arc tube wall can be redirected after such reflection, and such redirection can be accomplished by redirecting means in the form of either a secondary reflector or a refractor. In either case, an object of our invention is to cause light from the source that is reflected off the arc-tube reflective coating to approach individual points on the surface of the redirecting means at approximately the same incident angle as the direct light from the source approaches that point.

SUMMARY

In carrying out our invention in one form there is provided an electrodeless discharge lamp having an arc tube disposed in a lamp envelope and wherein the arc tube and lamp envelope are constructed of a light transmissive material. An excitation structure is disposed about the arc tube and is energizable with radio frequency current to develop an arc discharge within the arc tube. A reflective coating of non-conducting material is disposed on a portion of the arc tube nearest the excitation structure so that light output that would otherwise be blocked by said excitation structure is usefully directed out of said arc tube. The reflective coating is disposed on not more than approximately 70% of the arc tube and is effective for directing the light output from the arc discharge through the uncoated portion of the arc tube without interference from the excitation structure.

In a variation of our invention, we provided the electrodeless discharge lamp of the present invention in a luminaire that comprises (i) an enclosure comprising a wall portion having an opening at one end and (ii) a refractor of light-transmissive material mounted on the enclosure and covering the opening. The refractor has a prismatic surface for distributing light from the arc discharge that passes through the opening and is received and transmitted by the refractor.

BRIEF DESCRIPTION OF FIGURES

For a better understanding of the invention, reference may be had to the following detailed description taken in connection with the accompanying drawings wherein.

DETAILED DESCRIPTION

Figure 1:
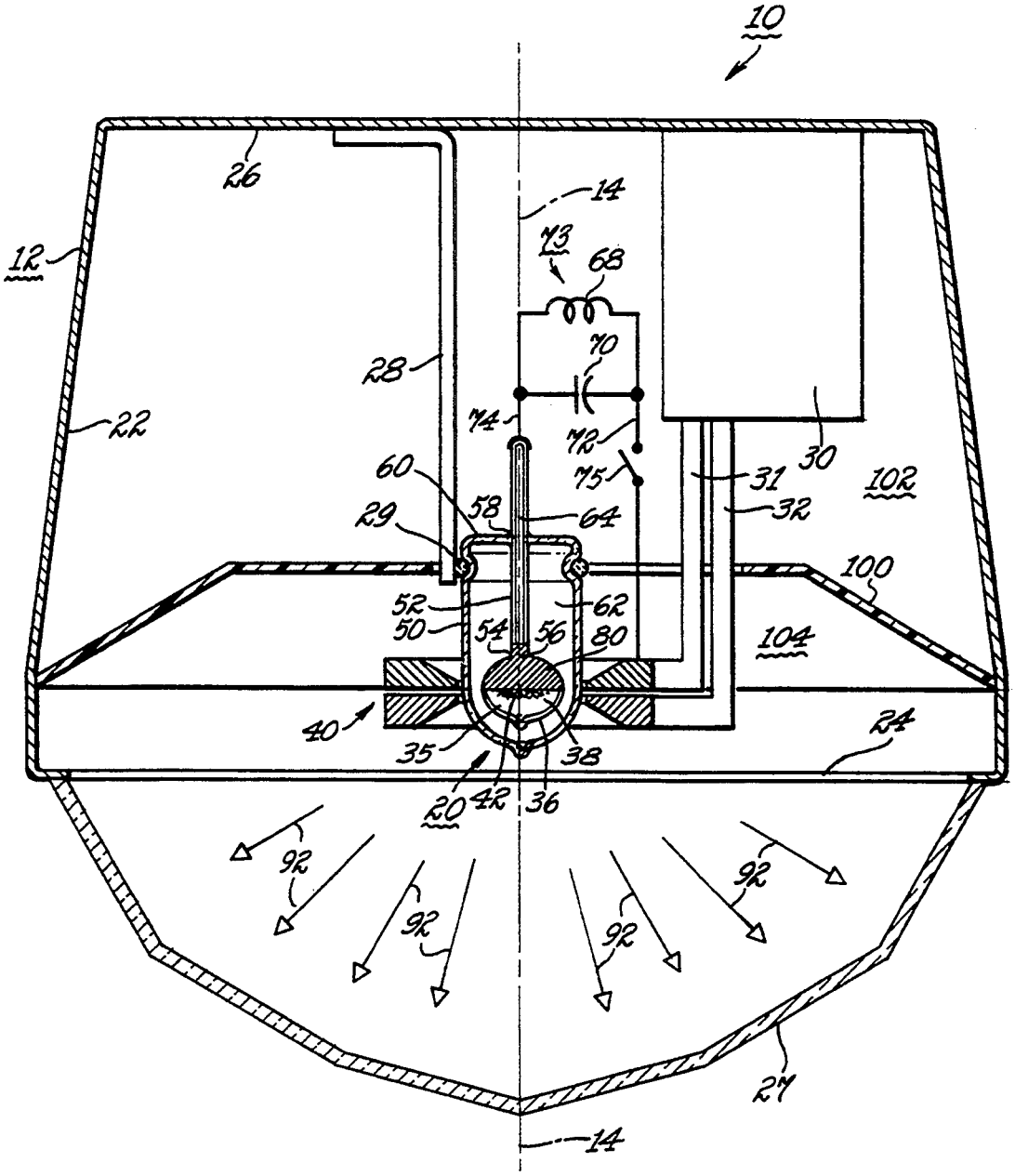
FIG. 1 is a sectional side-elevational view of a luminaire embodying one form of our invention and including an inductively-driven, electrodeless HID lamp and a refractor.

Referring now to FIG. 1, the luminaire 10 shown therein comprises a cup-shaped enclosure 12 having a central longitudinal axis 14. Disposed on the axis 14 is an inductively-driven electrodeless high intensity discharge (HID) lamp 20 which serves as the light source for the luminaire.

The cup-shaped enclosure 12 comprises a tubular wall portion 22 surrounding the axis 14 and terminating at its lower, or forward, end in an opening 24 through which light developed by the lamp 20 is transmitted. The enclosure 12 also includes an upper, or back, wall 26 at the top of its tubular wall portion 22. Suitable mounting structure (not shown) is attached to the upper wall 26 for mounting the luminaire.

The lamp 20 is supported within the enclosure 12 on the axis 14 by means of lamp-support structure 28 having its upper end attached to the upper wall 26 of the enclosure. At the lower end of the lamp-support structure 28 is a clamp 29 that surrounds an upper portion of the lamp and holds the lamp in a fixed position on axis 14.

Figure 2:
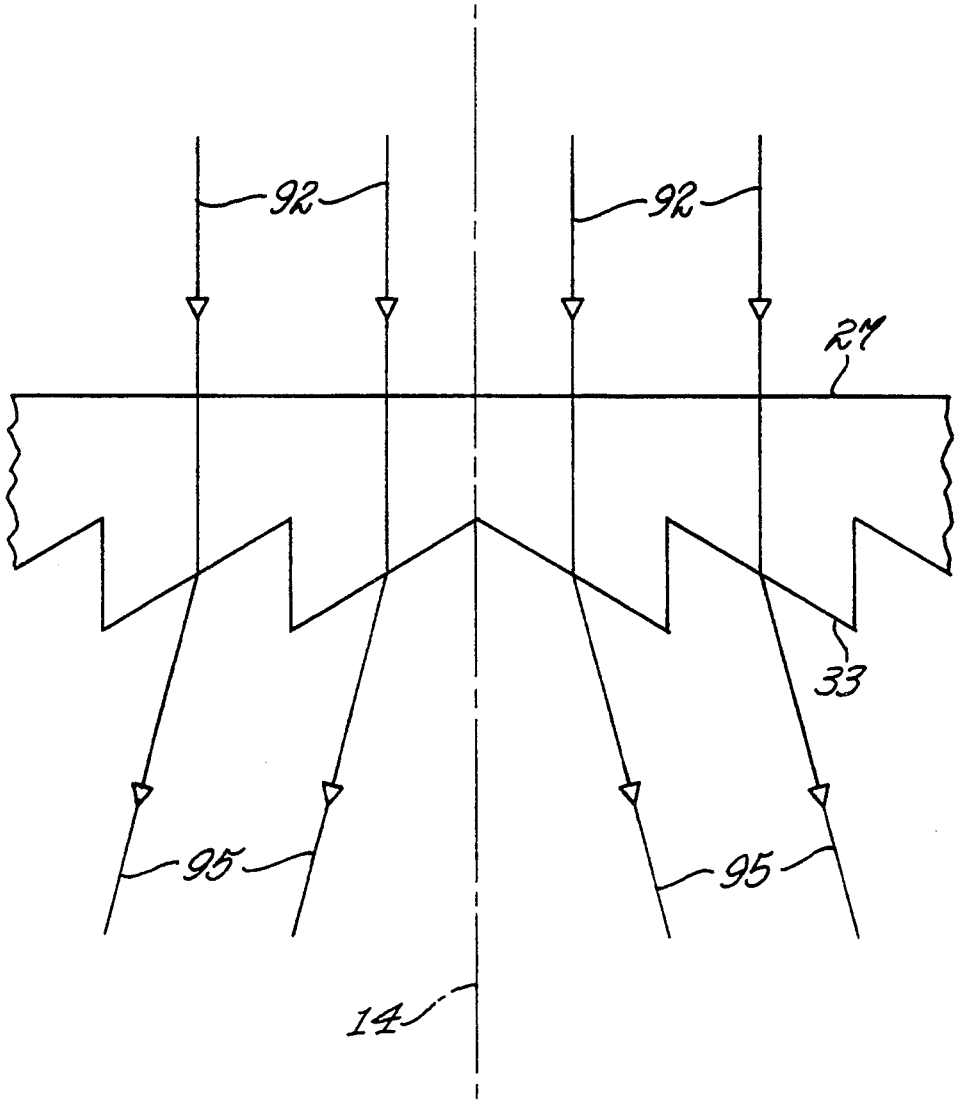
FIG. 2 is an enlarged detailed cross-sectional view of a portion of the refractor contained in the luminaire of FIG. 1.

Aligned with the opening 24 at the lower end of the enclosure 12 is a bowl-shaped refractor 27 of light-transmitting material, such as glass or a suitable plastic. As shown in FIG. 2, the refractor 27 has a prismatic outer surface containing many small prisms 33 that are shaped to direct the incident light received from source 20 to desired locations beneath the luminaire, thereby developing the desired pattern of light at the work plane beneath the luminaire. Although FIG. 2 shows only the prisms 33 that are located in the central region of the refractor, it is to be understood that similar prisms are disposed on the outer surface of additional regions of the refractor. The prisms 33 are discussed in more detail hereinafter.

Within the cup-shaped enclosure 12 is a suitable radio-frequency (RF) ballast 30 serving as a power supply for the lamp 20. This ballast 30 is coupled via conductors 31 and 32 to an excitation coil 40 for the lamp in a manner that will soon be described in more detail.

The electrodeless HID lamp is preferably of the general construction disclosed and claimed in copending U.S. patent application Ser. No. 622,026—Dakin et al, filed Dec. 4, 1990, assigned to the assignee of the present invention, and incorporated by reference herein. More specifically, referring to FIGS. 1 and 3, the lamp comprises an arc tube 35 having a wall 36 of light-transmissive material, such as fused quartz, surrounding an arcing chamber 38. The excitation coil 40 surrounds the arc tube 35 and is coupled to the RF ballast 30 for exciting a toroidal arc discharge 42 in the arc tube. This coupling is through conductors 31 and 32.

By way of example, the arc tube 35 is shown as having a substantially spherical wall 36. However, arc tubes of other suitable shapes may sometimes be desirable, depending upon the application, and are comprehended by our invention in its broader aspects. For example, the arc tube wall may be of a substantially ellipsoidal shape or may have the shape of a short cylinder, or pillbox, having rounded edges. An arc tube of the latter shape is shown and described in U.S. Pat. No. 4,810,938—Johnson et al, assigned to the assignee of the present invention. All of these shapes may be thought of as being globular.

The arcing chamber 38 within the arc tube 35 contains a fill within which the above-described arc discharge 42 of substantially toroidal shape is developed during lamp operation. A suitable fill is described in the above U.S. Pat. No. 4,810,938—Johnson et al. This fill comprises a sodium halide, a cerium halide, and xenon combined in weight proportions to generate visible radiation and exhibiting high efficacy and good color rendering capability at white color temperatures. For example, such a fill according to the Johnson et al patent may comprise sodium iodide and cerium chloride, in equal weight proportions, in combination with xenon at a room temperature partial pressure of about 500 torr. Another suitable fill is described in the copending U.S. patent application Ser. No. 348,433 of H. L. Witting, filed May 8, 1989, and assigned to the instant assignee. The fill of the Witting application comprises a combination of a lanthanum halide, a sodium halide, and xenon or krypton as a buffer gas. A specific example of a fill according to the Witting application comprises a combination of lanthanum iodide, sodium iodide, cerium iodide and 250 torr partial pressure of xenon at room temperature.

As illustrated in FIG. 1, RF power is applied to the HID lamp by RF ballast 30 via excitation coil 40. In the illustrated lamp, excitation coil 40 is a two-turn coil having a configuration such as that described in the commonly assigned, U.S. Pat. No. 5,039,903 issued to G. A. Farrall on Aug. 13, 1991, which patent is hereby incorporated by reference. The excitation coil of the Farrall patent comprises one or more turns connected in series. The shape of each turn is generally formed by rotating a bilaterally symmetric trapezoid about a coil center line situated in the same plane as the trapezoid, but which line does not intersect the trapezoid, and providing a cross-over means for connecting the turns.

In operation, RF current in coil 40 results in a time-varying magnetic field which produces within arc tube 35 an electric field that substantially closes upon itself. Once the lamp is started, as will soon be described, current flows through the fill within the arc tube 35 as a result of this solenoidal electric field, producing the toroidal arc discharge 42 in the fill. Suitable operating frequencies for RF ballast 30 are in the range from 0.1 to 300 megahertz (MHz), an exemplary operating frequency being 13.56 MHz.

A suitable ballast 30 is described in commonly assigned, U.S. Pat. No. 5,047,692 issued to J. C. Borowiec and S. A. El-Hamamsy on Sep. 10, 1991, which patent is hereby incorporated by reference. The lamp ballast of the cited patent is a high-efficiency ballast comprising a Class-D power amplifier and a tuned network and heat sink. In particular, two capacitors, the first in series combination and the second in parallel combination with the excitation coil, are integrated by sharing a common capacitor plate. Furthermore, the metal plates of the parallel tuning capacitor comprise heat conducting plates of a heat sink used to remove excess heat from the excitation coil of the lamp.

The arc tube 35 of FIG. 1 is enclosed by an outer envelope 50, preferably of quartz, that serves to reduce heat loss from the arc tube, and to protect the arc tube wall 36 from harmful surface contamination. The arc tube is also supported from the outer envelope 50 by means of a hollow stem 52 of elongated tubular configuration. In a preferred form of the invention, the arc tube wall is of quartz and the stem 52 is of quartz tubing joined through fusion to the outer surface of the quartz arc tube wall. In the localized region 54 where the quartz tubing is joined to the quartz arc-tube wall, the portion 56 of the arc-tube wall is substantially flat on both its outer surface and on its inner surface. In a location 58, spaced along the stem 52 from the region 54, the stem 52 extends through an opening in the top wall 60 of the outer envelope 50 and is fused about its outer periphery to the top wall to form a vacuum-tight seal. The space 62 between the outer envelope 50 and the arc tube 35 is evacuated so as to provide thermal insulation for reducing heat loss from the arc tube.

In the illustrated form of the invention, the stem 52 serves as a portion of a starting aid that is used for initiating operation of the lamp when desired. A lamp including such a starting aid is disclosed and claimed in the aforesaid copending application Ser. No. 622,026—Dakin et al assigned to the assignee of the present inventor and incorporated by reference herein. A detailed description of the operation of such a starting aid is contained in said application Ser. No. 622,026. The following several paragraphs provide a general description of the starting aid.

The upper end of the stem 52 is sealed off so that within the stem there is a closed chamber 64. This chamber is filled with a gas that has a substantially lower dielectric strength than that of the gaseous fill located within the arc tube 35, considered under the normal conditions prevailing just prior to start-up of the lamp 20. This gas that fills chamber 64 can be the same gas as present in the arc tube 35 but at a lower pressure than the gas present in the arc tube, e.g., at a pressure of about 1/10 of that of the arc tube. Alternatively, the gas in chamber 64 may be a different gas which can be broken down by high voltage. Examples of specific gases usable in the chamber 64 are krypton, xenon, neon, argon, helium, and mixtures thereof. In each case the pressure of this fill is low enough to impart a dielectric strength to the gas below that of the gas within arc tube 35. In one specific embodiment, the fill in chamber 64 is pure krypton at a room-temperature pressure of 20 torr. A specific example of a gas mixture that is advantageously usable is a Penning mixture consisting of neon and argon.

As noted hereinabove, stem, or container, 52 and the gas within its chamber 64 may be thought of as being part of a starting aid for assisting in the development of the toroidal arc discharge 42 in arc tube 35. In the illustrated lamp embodiment, the starting container 52 has one end wall (its lower end wall) which is constituted by a part of the wall portion 36 of the arc tube 35.

The starting aid further comprises means for developing and applying a high voltage to initiate breakdown in hollow container 52 and subsequently in arcing chamber 38. This means, schematically illustrated in FIG. 1, comprises the parallel combination of an inductor 68 and a capacitor 70 connected between a ground potential point on the upper turn of excitation coil 40 and the upper end of the starting container 52 via conductors schematically shown at 72 and 74. A suitable switch schematically shown at 75 connected in series with the parallel combination can be closed to connect the parallel combination across the ballast 30 through the stray capacitance of the lamp and can be opened to interrupt the circuit that connects the parallel combination across the ballast 30. Additional details of the voltage developing and applying means 68–75 are disclosed in commonly-assigned U.S. Pat. No. 5,103,140 issued to Cocoma et al on Apr. 7, 1992 and U.S. Pat. No. 5,057,750 issued to Farrall et al on Oct. 15, 1992, which patents are hereby incorporated by reference herein. The L-C circuit 68, 70 is tuned so that it is in a condition of approximate resonance when energized by the 13.56 MHz RF current of ballast 30. When a high voltage is developed across the L-C circuit 68, 70 by the RF current from ballast 30, a corresponding high voltage is applied across the length of starting container 52 and the column of gas therein to cause a dielectric breakdown of the gas. This breakdown develops into a discharge (not shown) that extends along the entire length of the chamber 64.

In a manner described in greater detail in the aforesaid application Ser. No. 622,026—Dakin et al, the above-described discharge within the starting container 52 triggers a dielectric breakdown of the fill gas within the arcing chamber 38 of the arc tube 35. This dielectric breakdown within arc tube 35 allows the electric and magnetic fields then being generated by RF current through the excitation coil 40 to develop within the arc tube a toroidal arc discharge of the form shown at 42 in FIG. 3. Thereafter, these electric and magnetic fields are capable of maintaining the toroidal arc discharge without assistance from the above-described starting discharge in chamber 64. Accordingly, the starting discharge is then extinguished in a suitable manner, e.g., by opening the switch 75 to interrupt the circuit 73 and thereby disconnect the starting discharge from its power source.

Figure 3:
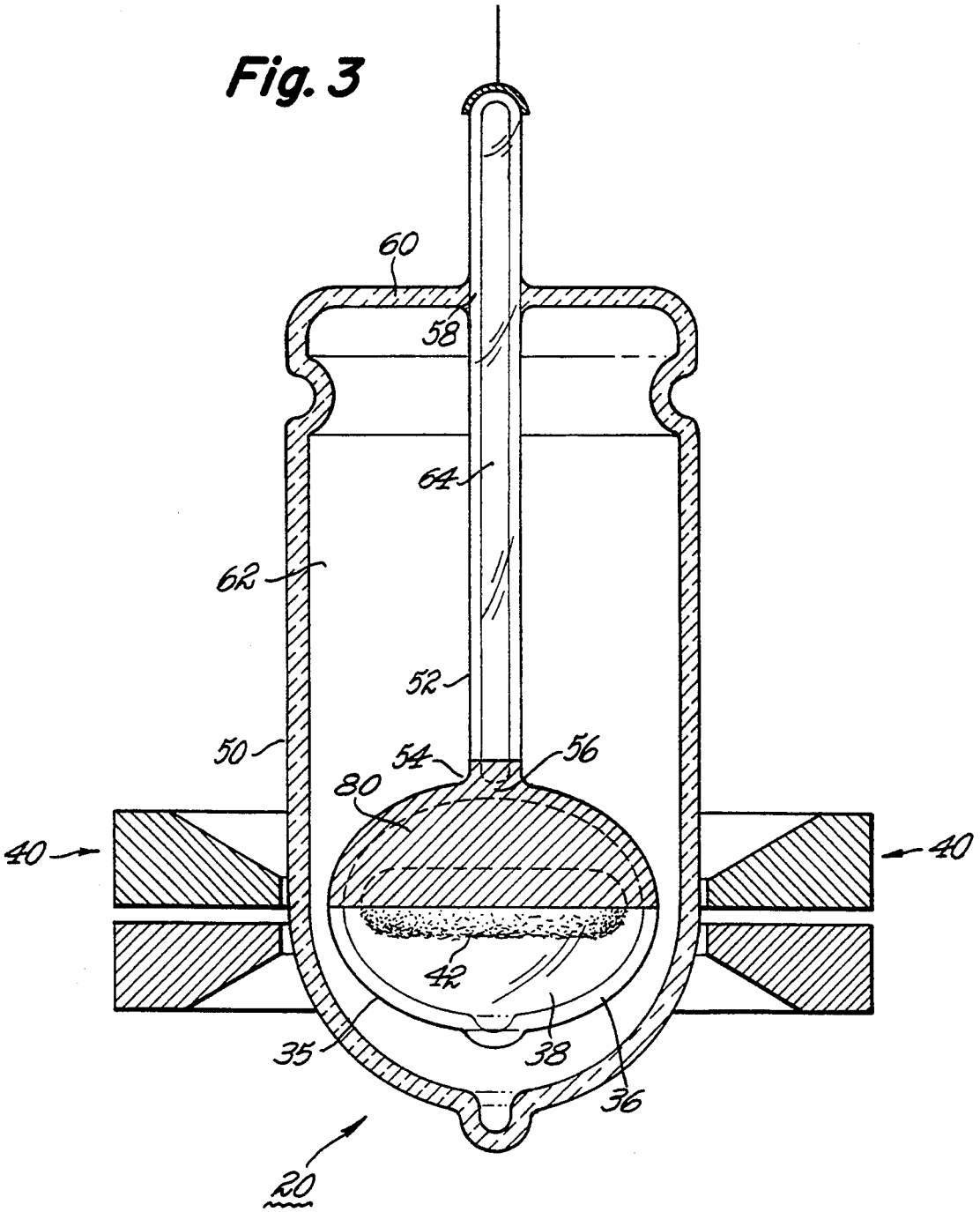
FIG. 3 is an enlarged partially sectional view of the electrodeless HID lamp component of FIG. 1.

The light developed by the toroidal arc discharge 42 is projected radially outward from the arc discharge in all directions. A portion of this light passes downward through the lower hemisphere of the spherical arc tube 35 and then through the opening 24 and the refractor 27 aligned therewith. The remaining portion of the light output from the arc discharge is intercepted by a reflective coating 80 that covers the outer surface of the upper hemisphere of the spherical arc tube 35. This reflective coating 80 acts to reflect the intercepted light downwardly and outwardly through the portion of the arc tube 36 which is not coated. As seen in FIG. 3, the non-conducting coating 80 is placed on approximately the upper half of the arc tube 36 and most notably, is placed on that portion of the arc tube 36 in closest proximity to coil 40. In this manner, light output that would otherwise be blocked by coil 40, is directed out of the arc tube 36 without impediment. It can be appreciated that although the coating is shown as being applied to the upper half of the arc tube 36, it is possible to apply such coating in a range of approximately 30–70% provided however that at least the equatorial surface of the arc tube 36 is covered.

Reflective coating 80 is of one or more electrically insulating materials, preferably a refractory insulating material, such as aluminum oxide. Other suitable materials are zirconia, titania, and magnesia. It is important that this coating be of electrically insulating material, rather than electroconductive material, in order to prevent eddy currents from being induced therein. If the coating were of electroconductive material, it would quickly overheat due to the eddy currents induced therein by the radio frequency field from the RF current through nearby excitation coil 40. Moreover, these eddy currents if allowed to develop in the coating, would generate their own magnetic and electric fields that would interfere with the desired fields developed by current through the excitation coil. The high temperatures developed by the arc discharge 42 require that the coating 80 be of a material, such as alumina, zirconia, titania, or magnesia, that is unimpaired by such temperatures. A preferred weight density for an alumina coating is about 10 mg/cm$^2$. The coating should be thick enough so that it is a good optical reflector.

The alumina coating material is prepared by mixing powdered alumina with a suitable liquid binder to suspend the alumina particles in the binder. This suspension is then applied to the outer surface of the upper hemisphere of the arc tube either by brushing, spraying, or dip-coating, following which the coating is suitably dried and baked to evaporate the binder and produce a good bond to the underlying quartz.

It will be noted that the reflective coating 80 is located between the toroidal arc discharge 42 and the excitation coil 40 and also between arc discharge 42 and all the structure above the arc tube 35. Accordingly, most of the light emitted by the arc and traveling toward the excitation coil 40 and the structure above the arc tube is intercepted by the reflective coating 80 and thereafter reflected by the coating through the light-transmissive bottom hemisphere of the arc tube 35 and then through the opening 24 and the aligned refractor 27. The above-described light traveling from the reflector 80 toward the refractor 27 is represented in FIG. 1 by light rays 92, shown as arrows oriented to depict the approximate travel direction of the light. FIG. 2 shows some of these light rays 92 in the region of the refractor 27 adjacent central longitudinal axis 14.

Because the reflector 80 is disposed in close proximity to the arc source 42 and between the source and the excitation coil 40 and the assorted luminaire structure above the arc tube, the reflector is able (1) to receive light from the source without interference from the excitation coil and the above-described assorted structure and (2) to reflect this light from the reflector (80) to the refractor (27) via uninterrupted paths that avoid the excitation coil and the assorted structure. This enables us to avoid the losses of light and control that would be present if the coil and/or the assorted structure was situated in these paths. Also we are able because of our reflector location to avoid the need for steering some of the light around the excitation coil and the assorted luminaire structure, thus avoiding the need for more complex reflector arrangements involving multiple reflections and resultant light losses.

In refractor-containing luminaires that rely upon reflective surfaces spaced relatively great distances from the source, e.g., on the luminaire enclosure, it is usually important that these reflective surfaces be specular and not diffuse in character so that the light reflected therefrom follows precise, predetermined paths to the refractor. This is the case because the prismatic surfaces on the refractor are typically designed to handle with efficiency light approaching each point thereon via a precise, predetermined path. The efficiency of these prismatic surfaces is impaired if the incident light to individual points thereon approaches via many diverse paths.

But in our luminaire, we are able to utilize a diffuse reflector because the reflector (80) is so small that it acts almost as a point source of light insofar as the refractor is concerned. Light reflected from our small reflector 80 is able to reach the refractor 27 via paths 92 without any need for additional reflections to avoid the excitation coil 40 and other potential impediments. The closeness of our reflector (80) to the source 42 is an important factor contributing to its small size. The reflector 80, it is noted, is many times closer to the source 42 than is the refractor 27. In the illustrated luminaire, the refractor is more than 10 times further from source 42 than is the reflector 80.

Another significant feature of our luminaire is that light from our reflector 80 is able to approach individual points on the prismatic surface of the refractor 27 at approximately the same angle as the direct light from source 42 approaches that point. Thus, if a prism is designed to steer direct light from the source into a predetermined emerging path, e.g., 95 in FIG. 2, it can steer the reflected light incident thereto into essentially the same emerging path. Referring to FIGS. 1 and 2, the direct light from source 42 approaches the refractor 27 via essentially the same paths 92 as the reflected light from reflector 80.

The fact that there is no need to steer light from reflector 80 around the excitation coil 40 and associated structure by relying upon multiple reflections further contributes to our being able to cause the reflected light to approach individual points on the prismatic surface of the refractor at approximately the same angle as the direct light from source 42 approaches that point.

As shown in FIG. 1, the luminaire 10 is provided with a partition 100 which divides it into two compartments 102 and 104. The compartment 102 above the partition contains the ballast 30, the starting circuitry 68–75, the top portion of lamp 20, and the supporting structure 28 for the lamp. The compartment 104 below the partition contains the lower portion of the lamp 20, including the excitation coil 40, and the relatively large space that is present between the lower portion of the lamp and refractor 27. Partition 100 is a circular member, upwardly dished in its central region and having the shape of an inverted dinner plate. In a preferred form of the invention, the lower surface of the partition 100 is reflective so that any light reaching it is reflected downwardly through the refractor 27 and can act as spill light.

While we have particularly described our invention in connection with a luminaire that includes as its light source an inductively-driven, electrodeless HID lamp, it is to be understood that our invention in its broader aspects comprehends a lighting device such as a luminaire that includes as its light source other types of electrodeless discharge lamps, e.g., capacitively-driven electrodeless discharge lamps. In each of these luminaires, the reflective coating of insulating material is applied directly to the arc tube wall and acts to intercept light from the arc discharge before it reaches the usual exciting means about the arc tube and to reflect such intercepted light via paths passing through an uncoated portion of the arc tube wall to the refractor without blockage by the exciting means.

While the invention is particularly applicable to a luminaire that includes a refractor for distributing the light generated therein, our invention in its broader aspects comprehends a lighting device such as a luminaire in which there is no refractor over its output opening. In certain applications, even without the refractor, the direct light and the light from the reflective coating (80) on the arc tube are distributed in a pattern that is sufficient to satisfy the light-distribution requirement of the particular application.

Figure 4:
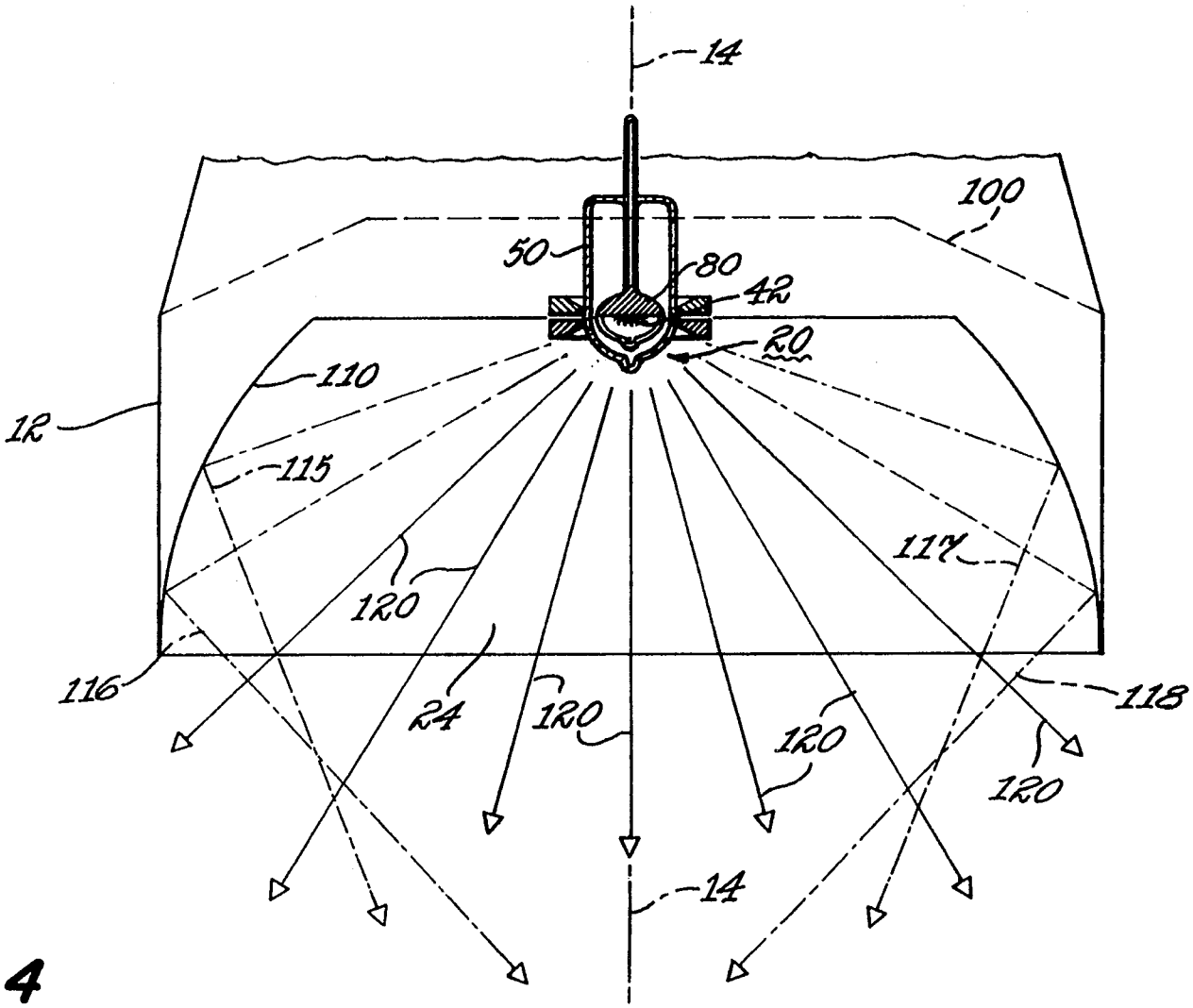
FIG. 4 is a schematic showing of a modified form of a luminaire.

Our invention in its broader aspects also comprehends a lighting device such as a luminaire that includes reflecting surfaces that are located to intercept light from the reflective coating 80 on the arc tube wall. An example of such a luminaire is shown in FIG. 4, where a secondary reflector 110 is mounted on the enclosure 12 in locations where it can intercept light rays from the reflective coating 80. The illustrated secondary reflector 110 is an annular member surrounding the central axis 14 of the enclosure. The inner reflective surface of member 110 is of such a configuration that it reflects the intercepted light received from coating 80 through the output opening 24 at the forward end of the enclosure 12, as illustrated by the rays 115, 116, 117, and 118 shown in dotted line form in FIG. 4. A large percentage of the direct light from the arc discharge 42 as well as a substantial percentage of reflected light from coating 80 passes through the output opening 24 by paths 120 which bypass the secondary reflector 110. In effect, the secondary reflector 110 intercepts direct light rays and reflected light rays from coating 80 that are disposed at relatively large polar angles with respect to axis 14, whereas those light rays disposed at smaller polar angles with respect to axis 14 extend through the output opening by paths (120) that bypass the secondary reflector 110.

In the luminaire of FIG. 4 the secondary reflector 110 is, in effect serving generally the same purpose as the refractor 27 of the luminaire of FIG. 1, i.e., it is redirecting the light output from source 42 to achieve the desired distribution of light exiting through output opening 24. In each case the distribution of incident angles at a given point on the light-redirecting element (110 or 27) is highly limited and substantially that which would be characteristic of a single ray from a small source directly to the given point. Thus, each small region of the secondary reflector can be optimally designed and the entire secondary reflector can maximize the utilization of light from the source.

Because the reflecting coating 80 in the luminaire of FIG. 4 is so small and so close to the light source 42, direct light rays from the source and light rays reflected from the reflective coating approach individual points on the light-redirecting means (secondary reflector 110) at essentially the same incident angle, just as in the luminaire of FIG. 1.

While we have shown and described particular embodiments of our invention, it will be obvious to those skilled in the art that various changes and modifications may be made without department from our invention in its broader aspects; and we, therefore, intend herein to cover all such changes and modifications as fall within the true spirit and scope of our invention.

What we claim as new and desire to secure by Letters Patent of the United States is:

1. A luminaire comprising:

(a) an enclosure comprising a hollow wall portion having an opening formed in one end thereof, (b) an electrodeless discharge lamp comprising an arc tube and an outer envelope surrounding said arc tube, said outer envelope being supported within said enclosure by a first support member, said arc tube being supported within said outer envelope by a second support member and having a wall of light-transmissive material, (c) exciting structure disposed about a portion of said arc tube and energizable with radio frequency current to develop within said arc tube, an arc discharge, (d) a reflective coating of electrically insulating material disposed on said arc tube wall near said second support member and around said portion of said arc tube about which said exciting structure is disposed and located to reflect light from said arc discharge through said opening of the enclosure via an uncoated portion of said arc tube wall, said uncoated portion occupying approximately at least 30% of the surface area of said arc tube and not more than 70% of said surface area and being disposed away from said exciting structure and said second support member so that light from said arc discharge can be reflected by said reflective coating and travel through said uncoated portion to said opening without blockage by said exciting structure and said first and second support members, and (e) light-redirecting means mounted on said enclosure for receiving reflected light from said reflective coating and redirecting said light to control the distribution of light output from the luminaire and to avoid reflectance of light back to said arc discharge.

2. The luminaire of claim 1 in which light rays reflected off said reflective coating approach individual points on said light-redirecting means at essentially the same incident angle as direct light rays from said arc discharge approach the same point.

3. The luminaire of claim 1 in which said light-redirecting means is a refractor of light-transmissive material mounted on said enclosure and covering said opening, said refractor having a prismatic surface for distributing light from said arc discharge that passes through said opening and is received by said refractor.

4. The luminaire of claim 1 in which said light-redirecting means comprises secondary reflecting means for intercepting light reflected off said reflective coating.

5. The luminaire of claim 1 in which:

(a) said outer envelope surrounds said arc tube in spaced relationship to said arc tube, at least a portion of said envelope being light transmissive, (b) said envelope is partially surrounded by said exciting structure and is spaced from said reflective coating on said arc tube wall, and (c) said reflective coating is located to reflect light from said arc discharge first through said uncoated portion of said arc tube wall, then through said light transmissive portion of said envelope, and then onto said light-redirecting means.

6. The luminaire of claim 1 in which:

(a) said arc tube wall is of globular form and said reflective coating is located on a portion of said globular-form arc tube wall opposite said opening, and (b) said light-redirecting means is located in a position to receive from said arc discharge direct light as well as indirect light reflected off said reflective coating.

7. The luminaire of claim 1 in which when the luminaire is in its normal position, said reflective coating is disposed on an upper portion of the arc tube wall, said light-redirecting means is disposed beneath the arc tube.

8. The luminaire of claim 1 wherein said reflective coating is of a material comprising one or more of the following: alumina, zirconia, titania, and magnesia.

9. The luminaire of claim 1 in which said reflective coating is a diffuse reflector of light from said arc discharge.

10. The luminaire of claim 9 wherein said reflective coating is of a material comprising one or more of the following: alumina, zirconia, titania, and magnesia.

11. The luminaire of claim 1 in which: said discharge lamp is an inductively-driven, electrodeless high-intensity discharge lamp; said exciting structure is a coil surrounding said arc tube, said reflective coating, and said uncoated portion of the arc tube wall; and said arc discharge is a toroidal arc discharge.

12. The luminaire of claim 2 in which: said discharge lamp is an inductively-driven, electrodeless high-intensity discharge lamp; said exciting structure is a coil surrounding said arc tube, said reflective coating, and said uncoated portion of the arc tube wall; and said arc discharge is a toroidal arc discharge.

13. The luminaire of claim 3 in which: said discharge lamp is an inductively-driven, electrodeless high-intensity discharge lamp; said exciting structure is a coil surrounding said arc tube, said reflective coating, and said uncoated portion of the arc tube wall; and said arc discharge is a toroidal arc discharge.

14. The luminaire of claim 4 in which: said discharge lamp is an inductively-driven, electrodeless high-intensity discharge lamp; said exciting structure is a coil surrounding said arc tube, said reflective coating, and said uncoated portion of the arc tube wall; and said arc discharge is a toroidal arc discharge.

15. The luminaire of claim 5 in which: said discharge lamp is an inductively-driven, electrodeless high-intensity discharge lamp; said exciting structure is a coil surrounding said arc tube, said reflective coating, and said uncoated portion of the arc tube wall; and said arc discharge is a toroidal arc discharge.

16. A luminaire comprising:

(a) an enclosure having a hollow wall portion terminating in a forward end having an output opening through which light developed within said enclosure can be transmitted, (b) an electrodeless discharge lamp comprising an arc tube and an outer envelope supported within said enclosure by a first support member, said arc tube being supported within said outer envelope by a second support member and having a wall of light-transmissive material, (c) exciting structure disposed about a portion of said arc tube and energizable with radio frequency current to develop an arc discharge;

(d) a reflective coating of electrically insulating material disposed on said arc tube wall near said second support member and around said portion of said arc tube about which said exciting structure is disposed and located to reflect light from said arc discharge through said forward end of the enclosure via an uncoated portion of said arc tube wall, said uncoated portion occupying approximately at least 30% of the surface area of said arc tube and not more than 70% of said surface area and being disposed relative to said exciting structure and said second support member so that light from said arc discharge can be reflected by said reflective coating and travel through said uncoated portion to said output opening without blockage by said exciting structure and said first and second support members; and (e) said enclosure surrounding said discharge lamp in a manner so as to avoid reflectance of light back onto said arc discharge.

17. The luminaire of claim 16 in which:

(a) said outer envelope surrounds said arc tube in spaced relationship to said arc tube, at least a portion of said envelope being light transmissive, (b) said envelope is partially disposed within said exciting structure and is spaced from said reflective coating on said arc tube wall, and (c) said reflective coating is located to reflect light from said arc discharge first through said uncoated portion of said arc tube wall, then through said light transmissive portion of said envelope, and then through said output opening.

18. The luminaire of claim 16 in which:

(a) said arc tube wall is of globular form and said reflective coating is located on a portion of said globular-form arc tube wall opposite to said forward-end opening, and (b) said output opening is located in a position to receive from said arc discharge direct light as well as indirect light reflected off said reflective coating.

19. The luminaire of claim 16 in which when the luminaire is in its normal position, said reflective coating is disposed on an upper portion of the arc tube wall and said output opening is disposed beneath the arc tube.

20. The luminaire of claim 16 in which said reflective coating is of a material comprising one or more of the following: alumina, zirconia, titania, and magnesia.

21. The luminaire of claim 16 in which said reflective coating is a diffuse reflector of light from said arc discharge.

22. The luminaire of claim 21 in which said reflective coating is of a material comprising one or more of the following: alumina, zirconia, titania, and magnesia.

23. The luminaire of claim 16 in which: said discharge lamp is an inductively-driven, electrodeless high-intensity discharge lamp; said exciting structure is a coil surrounding said arc tube, said reflective coating, and said uncoated portion of the arc tube wall; and said arc discharge is a toroidal arc discharge.

* * * * *